US008337050B2

(12) United States Patent
Lee et al.

(10) Patent No.: US 8,337,050 B2
(45) Date of Patent: Dec. 25, 2012

(54) LIGHT SOURCE MODULE

(75) Inventors: Te-Hua Lee, Taipei Hsien (TW); Che Chen, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 417 days.

(21) Appl. No.: 12/712,090

(22) Filed: Feb. 24, 2010

(65) Prior Publication Data

US 2011/0090700 A1 Apr. 21, 2011

(30) Foreign Application Priority Data

Oct. 20, 2009 (CN) ..... 2009 1 0308492

(51) Int. Cl.
*F21V 7/06* (2006.01)

(52) U.S. Cl. ..... 362/296.08; 362/296.01; 362/296.05; 362/296.07; 362/311.01; 362/311.02

(58) Field of Classification Search ..... 362/296.01, 362/296.05, 296.07, 296.08, 311.01, 311.02
See application file for complete search history.

(56) References Cited

U.S. PATENT DOCUMENTS

| | | | | |
|---|---|---|---|---|
| 6,945,672 | B2 * | 9/2005 | Du et al. | 362/241 |
| 7,635,206 | B2 * | 12/2009 | Huang | 362/296.01 |
| 7,940,003 | B2 * | 5/2011 | Kamikawa et al. | 313/512 |
| 2006/0215415 | A1 * | 9/2006 | Suzuki et al. | 362/539 |
| 2007/0279924 | A1 * | 12/2007 | Yagi | 362/509 |

* cited by examiner

*Primary Examiner* — Stephen F Husar
*Assistant Examiner* — James Cranson, Jr.
(74) *Attorney, Agent, or Firm* — Altis Law Group, Inc.

(57) ABSTRACT

A light source module includes a light source and housing. The housing includes a reflecting part, an installed part, and a stop. The reflecting part includes a paraboloidal surface configured for reflecting light beams from the light source. The light source is set in a focal point of the paraboloidal surface. The installed part is configured for installing the light source. The opening is configured for transmitting light beams reflected from the paraboloidal surface. The stop is perpendicularly connected with the installed part, and configured for preventing light beams from the light source from directly passing through the opening.

20 Claims, 1 Drawing Sheet

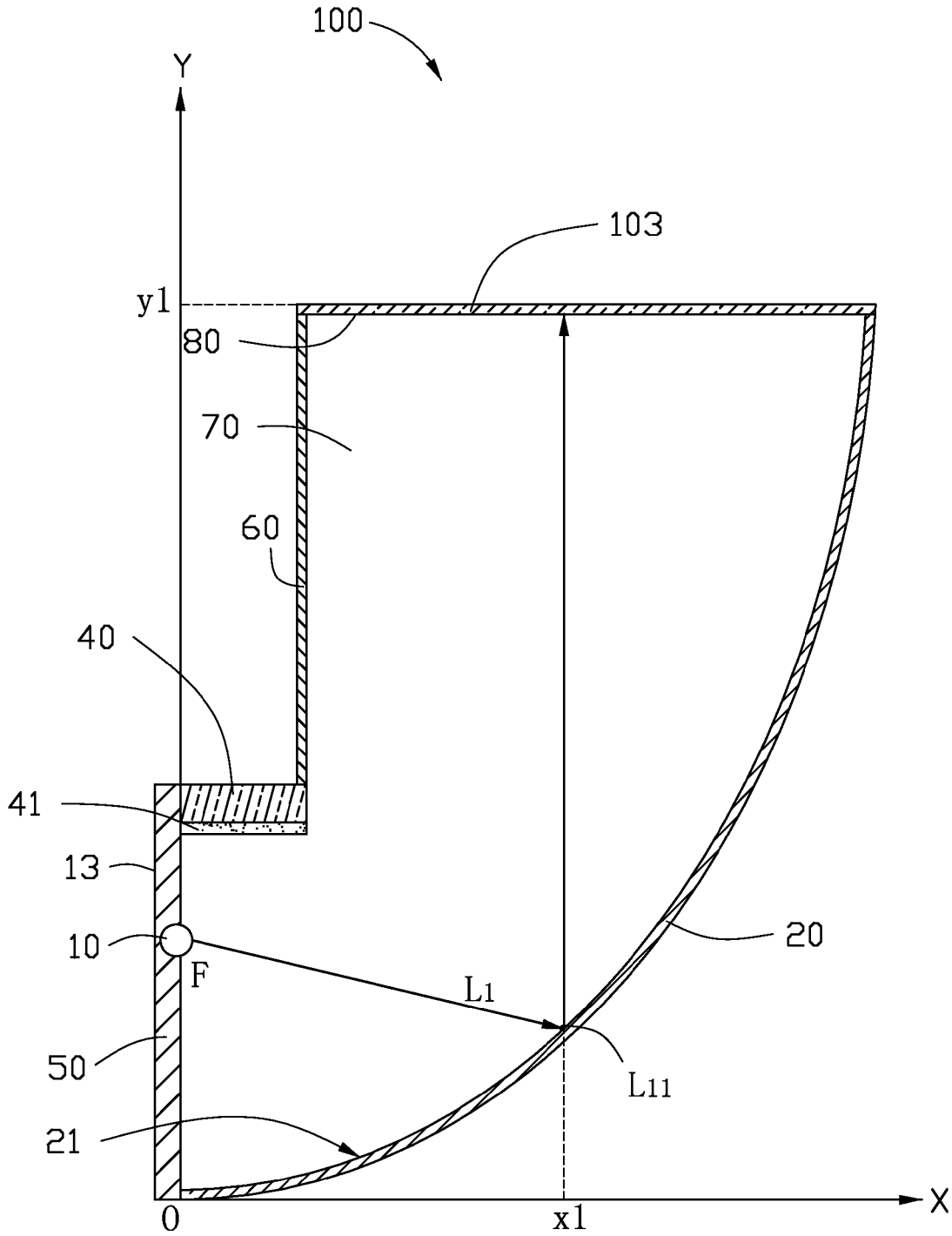
100
Y
103
y1
80
70
60
40
41
13
10
F
L1
L11
20
50
21
0
x1
X

LIGHT SOURCE MODULE

BACKGROUND

1. Technical Field

The present disclosure relates to light source modules, and more particularly, to a light source module with high uniformity of light emission.

2. Description of Related Art

Generally, for a light-transmissive plane, a light source is used as a back-light to illuminate the plane. For example, a light emitting diode (LED) may act as a light source to illuminate a logo arranged on a light-transmissive plane of a light source module. However, when the area of the light-transmissive plane is large and the light source is located in the center of the plane, the light intensity is stronger at the center of the light-transmissive plane than at the ends. Consequent non-uniformity in the light emission of the light-transmissive plane results in an unaesthetic appearance of the logo.

Therefore, there is room for improvement in the art.

BRIEF DESCRIPTION OF THE DRAWINGS

The components of the drawing are not necessarily drawn to scale, the emphasis instead being placed upon clearly illustrating the principles of the embodiments of a light source module with high uniformity of light emission. Moreover, in the drawing, like reference numerals designate corresponding parts throughout several views.

The drawing is a schematic view of a light source module in accordance with an exemplary embodiment.

DETAILED DESCRIPTION

Referring to the drawing, a light source module 100 in accordance with one embodiment is illustrated. The light source module 100 includes a light source 10, a light-transmissive plane 103, and a housing 13.

In this embodiment, the light source 10 is a point source, such as a light emitting diode (LED). In other embodiments, the light source 10 can be other light source, such as an incandescent bulb.

The light-transmissive plane 103 is configured to allow light beams from the light source 10 to pass through. The light-transmissive plane 103 includes a decoration such as an emblem or logo (not shown). In this embodiment, the decoration is embedded in the light-transmissive plane 103. In other embodiments, the decoration can be printed on the light-transmissive plane 103. In this embodiment, the light-transmissive plane 103 is a light-transmissive board.

The housing 13 is configured for receiving the light source 10, and changing the path of light beams from the light source 10 to impinge uniformly on the light-transmissive plane 103. In this embodiment, the housing 13 includes a reflecting part 20, a stop 40, an installed part 50, and a supporting part 60. A receiving chamber 70 is defined by successive connection of the reflecting part 20, the installed part 50, the stop 40, and the supporting part 60. The reflecting part 20 and the supporting part 60 together define an opening 80, which is arranged on an optical path of the reflecting part 20. The opening 80 allows light beams from the light source 10, after reflection, to impinge and pass through the light-transmissive plane 103. The light-transmissive plane 103 is flatly covering the opening 80.

The reflecting part 20 is configured for reflecting light beams from the light source 10 to the light-transmissive plane 103. The reflecting part 20 includes a paraboloidal surface 21 for reflecting light. The paraboloidal surface 21 is arranged at the inside surface of the reflecting part 20. In this embodiment, reflecting material is printed on the paraboloidal surface 21 for high reflectivity.

For clearly describing the paraboloidal surface 21, a rectangular coordinate O-XY is defined as shown in the drawing. The rectangular coordinate O-XY includes an origin O, an abscissa X, and an ordinate Y. The origin O of the coordinate axis is defined at a bottom of the paraboloidal surface 21. The ordinate Y is defined to pass through a focal point F of the paraboloidal surface 21. Therefore the paraboloidal surface 21 can be depicted by an parabolic equation $x^2=2py$, wherein p is a constant. The coordinates of the focal point F is $(x=0, y=p/2)$.

The installed part 50 is configured for installing the light source 10. The installed part 50 is a flat board extending from the bottom of the paraboloidal surface 21 and passing through the focal point F of the paraboloidal surface 21. The light source 10 is fixed in the focal point F of the paraboloidal surface 21. Thus the light beams reflected by the paraboloidal surface 21 are parallel with each other.

The stop 40 is configured for stopping light beams from the light source 10 directly emitting to the light-transmissive plane 103. The stop 40 is perpendicularly connected between the installed part 50 and the supporting part 60, and is arranged between the light source 10 and the light-transmissive plane 103. In this embodiment, skirt fringe of the stop 40, skirt fringe of the light-transmissive plane 103, and the light source 10 are in a same paraboloid. The stop 40 includes a film 41 facing the light source 10. The film 41 is configured for absorbing light beams from the light source 10 that impinge on it. The film 41 is black, and made from black colored material, such as black varnish or black nano material. In this embodiment, the stop 40 is planar, and includes a plane surface for stopping part of light beams from the light source 10 directly emitting to the light-transmissive plane 103. In other embodiments, the stop 40 includes a curved surface for preventing light beam from the light source 10 directly emitting to the light-transmissive plane 103.

The supporting part 60 is configured for supporting the light-transmissive plane 103. The supporting part 60 is perpendicularly connected with the stop 40, and is perpendicularly arranged between the stop 40 and the light-transmissive plane 103.

Assuming the light source 10 emits a light beam L1, randomly. A point L11 is defined by the light beam L1 arrived on the paraboloidal surface 21, and coordinates of the point L11 is $(x=x1, y=x1^2/(2p))$. Distance between the focal point F and the point L11 is $((p/2-x1^2/(2p))^2+x1^2)^{1/2}$, which is equal or reduces to $p/2+x1^2/(2p)$. Distance between the point L11 and the light-transmissive plane 103 is $y1-x1^2/(2p)$, wherein y1 is perpendicular distance between the light-transmissive plane 103 and the bottom of the paraboloidal surface 21. Distance of the light beam L1 from the light source 10 to the light-transmissive plane 103 is $p/2+x1^2/(2p)+y1-x1^2/(2p)$, which is $p/2+y1$. The constant p is based on the parabolic equation $x^2=2py$ of the paraboloidal surface 21. Thus, all light rays or beams from the light source 10 to the light-transmissive plane 103 after reflected by the paraboloidal surface 21 has the same distance of $p/2+y1$. Light intensities at the light-transmissive plane 103 are uniform.

As discussed above, light beams from the light source 10 of the light source module 100, after reflection by the paraboloidal surface 21 of the reflecting part 20, can be uniform with the light-transmissive plane 103 of the light source module 100. Consequently, the light emission of the light-transmissive plane 103 is uniform, and the decoration in the light-transmissive plane 103 then has a pleasant aesthetic appeal.

In other embodiments, the reflecting part 20 can define a first wall including the paraboloidal surface 21 for reflecting light beams from the light source 10, and the stop 40, the installed part 50, and the supporting part 60 can together define a second wall. The second wall cooperates with the first wall to form the housing 13. The stop 40 is a stop portion of the second wall.

It is to be understood, however, that even though numerous has been described with reference to particular embodiments, but the present disclosure is not limited to the particular embodiments described and exemplified, and the embodiments are capable of considerable variation and modification without departure from the scope of the appended claims.

What is claimed is:

1. A light source module, comprising:

a light source;

a housing comprising:

a reflecting part comprising a paraboloidal surface configured for reflecting light beams from the light source, the light source set in a focal point of the paraboloidal surface;

an installed part configured for installing the light source; wherein the installed part extends from a bottom of the paraboloidal surface and passes through the focal point of the paraboloidal surface;

an opening configured for transmitting light beams reflected from the paraboloidal surface; and a stop perpendicularly connected with the installed part, the stop configured for preventing light beams from the light source from directly passing through the opening.

2. The light source module of claim 1, wherein the light source comprises a light emitting diode.

3. The light source module of claim 1, wherein the stop comprises a planare surface for preventing part of light beams from the light source from directly passing through the opening.

4. The light source module of claim 1, wherein the stop comprises a curved surface for preventing part of light beams from the light source from directly passing through the opening.

5. The light source module of claim 1, wherein the stop comprises a film facing to the light source, the film is configured for absorbing the light beams from the light source that impinge on it.

6. The light source module of claim 5, wherein the film is made from black colored material.

7. The light source module of claim 1, wherein each ray of light from the light source after reflected by the paraboloidal surface has travelled substantially the same distance to the opening.

8. The light source module of claim 7, wherein the travelled distance is p/2+y1, p is a constant based on a parabolic equation ×2=2py of the paraboloidal surface, and y1 is the perpendicular distance between the opening and the bottom of the paraboloidal surface.

9. The light source module of claim 1, wherein the housing further comprises a supporting part, the supporting part is perpendicularly connected with the stop and is perpendicular with the opening.

10. The light source module of claim 9, wherein the reflecting part and the supporting part together define the opening arranged on an optical path of the reflecting part.

11. The light source module of claim 1, wherein the housing further comprises a light-transmissive plane covering the opening, the light-transmissive plane is configured to allow light beams from the light source after being reflected by the paraboloidal surface to pass through.

12. The light source module of claim 11, wherein the light-transmissive plane comprises a decoration.

13. The light source module of claim 12, wherein the decoration is embedded in the light-transmissive plane.

14. The light source module of claim 12, wherein the decoration is printed on the light-transmissive plane.

15. A light source module, comprising:

a light source;

a first wall comprising a paraboloidal surface for reflecting light beams from the light source, the paraboloidal surface defining a focal point;

a second wall cooperating with the first wall to form a housing, the housing defining an opening, the second wall connected with the first wall and intersects the focal point; and a light-transmissive board covering the opening;

wherein the light source is fixed at the focal point, the second wall comprises a stop portion arranged to block light beams from the light source from directly impinging on the light-transmissive board.

16. The light source module of claim 15, wherein each ray of light from the light source after reflected by the paraboloidal surface has travelled substantially the same distance to the light-transmissive board.

17. The light source module of claim 16, wherein the travelled distance is p/2+y1, p is a constant based on a parabolic equation ×2=2py of the paraboloidal surface, and y1 is the perpendicular distance between the light-transmissive board and the bottom of the paraboloidal surface.

18. A light source module, comprising:

a light source;

a housing comprising:

a reflecting part comprising a paraboloidal surface configured for reflecting light beams from the light source, the light source set in a focal point of the paraboloidal surface;

an installed part configured for installing the light source;

an opening configured for transmitting light beams reflected from the paraboloidal surface; and a stop perpendicularly connected with the installed part, the stop configured for preventing light beams from the light source from directly passing through the opening;

wherein the housing further comprises a light-transmissive plane covering the opening, the light-transmissive plane comprises a decoration and is configured to allow light beams from the light source after being reflected by the paraboloidal surface to pass through.

19. The light source module of claim 18, wherein the decoration is embedded in the light-transmissive plane.

20. The light source module of claim 18, wherein the decoration is printed on the light-transmissive plane.

* * * * *